United States Patent [19]

Boag

[11] 4,026,624

[45] May 31, 1977

[54] LOCKING STRUCTURE FOR ELECTRICAL CONNECTORS

[75] Inventor: John Boag, Ferndale, Mich.

[73] Assignee: Ford Motor Company, Dearborn, Mich.

[22] Filed: Sept. 3, 1976

[21] Appl. No.: 720,289

[52] U.S. Cl. ..... 339/91 R

[51] Int. Cl.[2] ..... H01R 13/12; H01R 13/54

[58] Field of Search ..... 339/75 R, 91 R, 75 M; 292/19, 20,31, 87; 285/317, 314, 320

[56] References Cited

UNITED STATES PATENTS

| | | | |
|---|---|---|---|
| 3,869,191 | 3/1975 | Tolnar et al. | 339/91 R X |
| 3,933,406 | 1/1976 | Cameron et al. | 339/91 R |

FOREIGN PATENTS OR APPLICATIONS

| | | | |
|---|---|---|---|
| 737,662 | 9/1955 | United Kingdom | 339/75 M |

*Primary Examiner*—James F. Coan

*Assistant Examiner*—E. F. Desmond

*Attorney, Agent, or Firm*—William E. Johnson; Keith L. Zerschling

[57] ABSTRACT

A locking structure for a pair of matable electrical connectors is disclosed. The locking structure includes a double ramp member formed on one of the connectors and a pair of cantilever beams formed on the other connector. The cantilever beams have cam locking surfaces and cam releasing surfaces thereon which coact with the double ramp member of the other connector to permit mating and unmating of the connectors. During mating of the connectors, the cantilever beams ride up the double ramp member to provide the forces required to ensure proper mating of the connectors. During unmating of the connectors, the cam releasing surfaces of the cantilever beams permit spreading of the cantilever beams and movement around the double ramp member so that the connectors are easily unmated.

3 Claims, 7 Drawing Figures

LOCKING STRUCTURE FOR ELECTRICAL CONNECTORS

BACKGROUND OF THE INVENTION

This invention is directed to the field of matable electrical connectors for establishing electric circuits between pairs of connectors. More specifically, the present invention is directed to that portion of the above-noted field which is concerned with the mechanism by which matable connectors are maintained in assembled relationship. More particularly still, the present invention is directed to that portion of the above-noted field which is concerned with mechanisms by which matable pairs of connector blocks are held in assembled relationship by an overcenter locking type mechanism which may be easily intentionally separated while maintaining a positively locked relationship when separation is not intended.

Electrical connectors of the general type described above are disclosed in U.S. Pat. No. 3,933,406 issued Jan. 20, 1976 for an Electrical Connector Block Assembly Having Overcenter Locking, which patent is assigned to the same assignee as this patent application. The abovenoted patent is hereby incorporated by reference. The abovenoted patent contains an excellent discussion of the requirements associated with mating of electrical connectors, particularly those electrical connectors which are utilized in automotive vehicles. This patent also contains a description of the prior art and shows a particular system for overcoming the disadvantages noted in the prior art. This patent also contains a full discussion of the requirements for securing proper mating of electrical connections and the desirability of providing an electrical connector which gives all the desired mating characteristics but also permits easy unmating of such connectors when separation of the connectors is desired.

It is the principal object of this invention to provide an easily releasable overcenter locking structure for a pair of matable connectors which is simple and efficient in operation, which provides the necessary structure to achieve proper mating of the connectors, but which provides for release of such mated connectors by simply pulling on the same and without utilizing specially designed tools.

SUMMARY OF THE INVENTION

This invention is directed to easily releasable overcenter locking structure for a pair of matable electrical connectors, and more particularly, to such an overcenter locking structure which is easy and efficient in the releasing of a mated pair of connectors but yet still is efficient in achieving the mating of the connectors.

In accordance with the teachings of this invention, the easily releasable overcenter locking structure for a pair of matable electrical connectors includes a double ramp member formed on one of the connectors and a pair of cantilever beams for coacting with the double ramp member formed on the other connector.

The double ramp member formed on one of the connectors inlcudes a first inclined ramp surface of generally fixed width leading from a front face of the one connector upwardly to an apex. A second inclined ramp surface leads downwardly from the apex in a direction away from the first inclined ramp surface to a surface of the one connector. The apex of the double ramp member is intermediate the locations at which the first and the second inclined ramp surfaces intersect the surface of the one connector. The second ramp surface has a B wedge shape when viewed directly downwardly at the apex of the double ramp member, the wide portion of the wedge shape being at the apex and the narrow portion of the wedge shape being at the point of intersection of the second ramp surface and the surface of the connector.

The pair of cantilever beams formed on the other of the matable connectors includes supporting portions of each of the cantilever beams extending upwardly from a rear portion of a surface of the other connector with the cantilever beams projecting forwardly therefrom in a parallel, spaced relationship towards a front face of the other connector. The spacing between the cantilever beams is slightly greater than the generally fixed width of the first inclined surface of the double ramp member. Each of the cantilever beams has at its free end an enlarged portion which projects into the space between the cantilever beams towards but not into engagement with the enlarged portion on the other one of the cantilever beams thereby defining a space between the enlarged portions. Each of the enlarged portions have a cam releasing surface which, when viewed from directly above the cantilever beams, is inclined inwardly from the small space between the enlarged portion generally towards a rear portion of the cantilever beam with which said enlarged portion is associated. Each of the enlarged portions also have a cam locking surface which, when viewed from the front face of the other connector, extends generally downwardly and rearwardly from a top surface of each of the cantilever beams.

When the structure above described is used for mating and unmating electrical connectors, the following actions are achieved. During movement of the pair of matable connectors towards a mated position, the cantilever beams are deflected upwardly by engagement of the cam locking surfaces and the first inclined ramp surface of the double ramp member. This action develops the forces required to provide the necessary drive home force to ensure proper mating of the terminals held within the electrical connectors. The cantilever beams and their enlarged portions surround the double ramp member after movement over the apex to lock the matable connectors in a mated position. The cam releasing surfaces of the enlarged portions of the cantilever beams are drawn along the wedge shape of the second ramp surface of the double ramp member to spread the cantilever beams apart to permit easy unmating of the mated connectors.

DESCRIPTION OF THE PREFERRED EMBODIMENT

Figure 1:
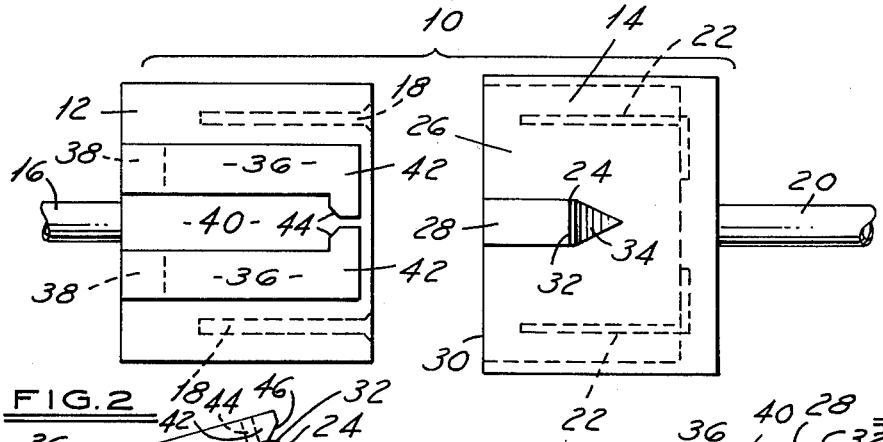
FIG. 1 is a plan view of the matable electrical connectors of this invention.

In FIG. 1 there is seen a pair of matable electrical connectors generally identified by the numeral 10. The connectors include a male connector 12 and a female connector 14. An electrical lead 16 carries wiring structure (not shown) to blade receiving electrical connectors 18 of known construction housed within the male connector 12. Similarly, female connector 14 has an electrical lead 20 associated therewith which is connected by wiring structure (not shown) to a pair of blade connectors 22. The type and shape of the electrical connectors housed within the male connector 12 and the female connector 14 is a matter of choice to the designer. Any of the many hundreds of different types of terminals and connectors may be utilized along with the structure of this particular invention which provides an easily releasable overcenter locking structure.

The overcenter locking structure for a pair of matable electrical connectors as taught in this invention may be best understood by viewing FIGS. 1 through 5 while the structure is described. Also, the structure shown in the drawings includes upper and lower locking structure. The description in this portion of the specification will describe only the upper structure, but the lower structure operates in the same manner. It is best to utilize upper and lower structures if there are four or more electrical connections to be made between the matable connectors. If there are three or less connections to be made, only a single releasable overcenter locking structure is suggested. This releasable overcenter locking structure can also be used with another cantilever locking device which are already known in the art. With this brief introduction, reference is now made to the drawings for a description of the releasable overcenter locking structure.

A double ramp member 24 is formed on the top surface 26 of the female connector 14. This double ramp member 24 has a first inclined ramp surface 28 of a generally fixed width leading from a front face 30 of the female connector 14 upwardly to an apex 32 of the double ramp member 24.

Figure 4:
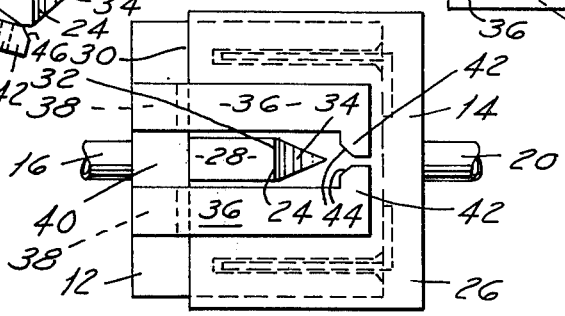
FIG. 4 is a plan view of the electrical connectors in a mated position.
Figure 5:
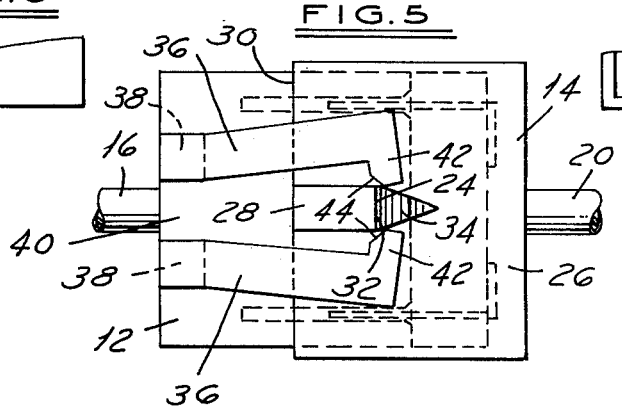
FIG. 5 is a plan view of the mated connectors moving towards an unmated condition.

A second inclined ramp surface 34 leads downwardly from the apex 32 of the double ramp member 24 in a direction away from the first inclined ramp surface 28 to a final position at the top surface 26 of the female connector 14. The apex 24 of the double ramp member 24 is intermediate the locations at which the first inclined ramp surface 28 and the second inclined ramp surface 34 intersect the top surface 26 of the female connector 14. As is best seen in FIGS. 1, 4 and 5, the second inclined ramp surface 34 has a generally wedge shape when viewed looking directly downwardly at the apex 32 of the double ramp member 24. The wide portion of the wedge shape is at the apex 32 and the narrow portion of the wedge shape is at the point of intersection of the second ramp surface 34 and the top surface 26 of the female connector 14.

The male connector 12 is provided with an upper pair of cantilever beams 36. Supporting portions 38 of the cantilever beams 36 extend upwardly from a rear portion of a top surface 40 of the male connector 14 and support the cantilever beams 36 so that they project forwardly therefrom in a parallel, spaced relationship towards the front face 30 of the female connector 14. The spacing between the cantilever beams 36—36 is slightly greater than the generally fixed width of the first inclined ramp surface 28 of the double ramp member 24.

Each of the cantilever beams 36—36 has at its free end an enlarged portion 42 which projects into the space between the cantilever beams towards but not into engagement with the enlarged portion 42 on the other one of the cantilever beams 36 whereby a space exists between the opposed enlarged portions 42—42. Each of the enlarged portions 42 have a cam releasing surface 44 thereon which can best be seen in FIGS. 1, 4 and 5. When the cam releasing surface 44 is viewed from directly above the cantilever beams 36—36, this cam releasing surface 44 is inclined inwardly from the small space between the enlarged portions 42 of the cantilever beams 36—36 generally towards a rear portion of the cantilever beam 36 with which the enlarged portion 42 is associated.

Figure 2:
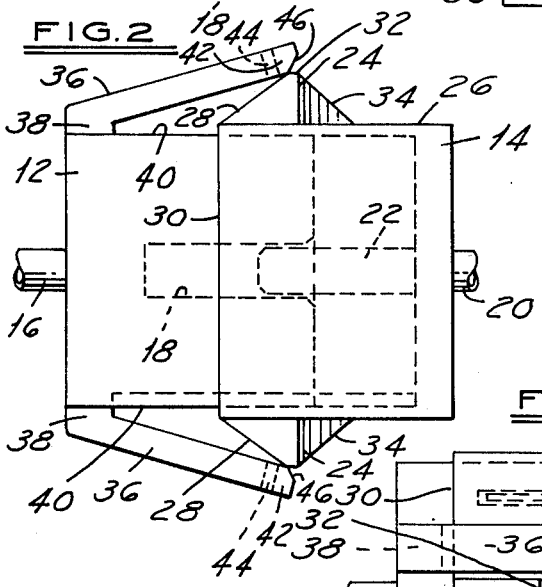
FIG. 2 is a side elevational view of the electrical connectors moving to a mated position.
Figure 3:
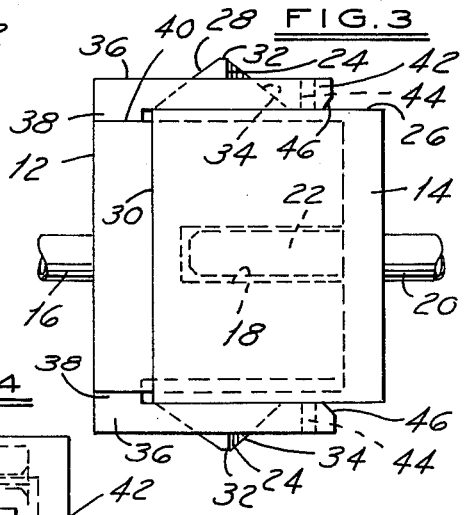
FIG. 3 is a side elevation view of the electric connectors in the mated position.

Each of the enlarged portions 42 of the cantilever beams 36 has a cam locking surface 46 best seen in FIGS. 2 and 3. This cam locking surface, when viewed from the front face of the connector, extends generally downwardly and rearwardly from a top surface of each of the cantilever beams 36—36.

Figure 6:
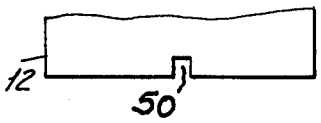
FIGS. 6 and 7 show a drawer slide structure used for guiding the electrical connectors to and away from mated positions.
Figure 7:
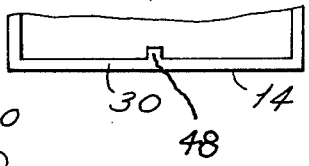

As is best seen in FIGS. 6 and 7, a drawer slide type of structure is provided for the matable electrical connectors 10 to align the same during a mating operation. The drawer slide structure consists of a raised portion 48 formed in the female connector 14 and a grooved recess 50 formed in the male connector 12. When the connectors 12 and 14 are being brought to a mated condition, the grooved recess 50 is guided by the raised portion 48 to assure accurate alignment of the cantilever beams 36—36 and the double ramp member 24.

OPERATION

The easily releasable overcenter locking structure of this invention operates in the manner to be described herein below. The male connector 12 and the female connector 14 are brought together so that the raised portion 48 of the female connector is located in the grooved recess 50 of the male connector 12. The connectors are then moved towards each other, this action causing the cantilever beams 36—36 to be deflected upwardly from the top surface 40 of the male connector 12 because the cam locking surface 46 of the enlarged portions 42 of the cantilever beams 36 engages and moves upwardly along the first inclined ramp surface 28 of the double ramp member 24 mounted on the female connector 14. This deflecting action is best shown in FIG. 2. The purpose of this deflecting action is to build up a force developed by pushing the cantilever beams up the ramps. When the cantilever beams pass over the apex 32 of the double ramp member 24, the male connector and female connector are driven together with sufficient force to insure that the blade connectors 22 are properly united with the blade receiving connectors 18, thereby assuring proper electrical connection.

FIGS. 3 and 4 illustrate the electrical connectors in a locked condition. In this condition, the cantilever beams 36—36 and the enlarged portions 42 thereof surround the double ramp member 24 to retain the connectors in their mated position.

When one desires to unmate the mated connectors, they simply pull on the electric wired lead 16 of the male connector and the cam releasing surface 44 formed on each of the enlarged portion 42 of the cantilever beams 36—36 are drawn along the wedge shape of the second inclined ramp 34 of the double ramp member 24 to thereby spread the cantilever beams 36—36 apart to permit easy unmating of the matable connectors. In this unmating operation, the cantilever beams 36—36 are not deflected upwardly from the top surface 40 of the male connector 12 whereby no substantial forces resisting unmating of the connectors are developed.

There has been disclosed herein an easily releasable overcenter locking structure to be used for mating a pair of matable electrical connectors. In view of the teachings of this specification, there will be many modifications of this structure which will be apparent to those skilled in the art. It is intended that all such modifications which fall within the true spirit of this invention, be included within the scope of the appended claims.

What I claim is:

1. In combination with a pair of matable electrical connectors, easily releasable overcenter locking structure comprising:

a double ramp member formed on one of the matable connectors, said double ramp member having a first inclined ramp surface of generally fixed width leading from a front face of the one connector upwardly to an apex and a second inclined ramp surface leading downwardly from said apex in a direction away from said first inclined ramp surface to a surface of the one connector; said apex of said double ramp member being intermediate the locations at which said first and said second inclined ramp surfaces intersect the surface of the one connector; said second ramp surface having a wedge shape when viewed looking directly downwardly at said apex of said double ramp member, the wide portion of said wedge shape being at said apex and the narrow portion of said wedge shape being at the point of intersection of said second ramp surface and the surface of the connector; and a pair of cantilever beams formed on the other of the matable connectors, supporting portions of each of said cantilever beams extending upwardly from a rear portion of a surface of the other connector with said cantilever beams projecting forwardly therefrom in a parallel, spaced relationship towards a front face of the other connector; the spacing between said cantilever beams being slightly greater than said generally fixed width of said first inclined ramp surface of said double ramp member; each of said cantilever beams having at its free end an enlarged portion which projects into the space between said cantilever beams towards but not into engagement with said enlarged portion on said other one of said cantilever beams whereby a small space exists between said enlarged portions; each of said enlarged portions having a cam releasing surface which, when viewed from directly above said cantilever beams, is inclined inwardly from said small space between said enlarged portions generally towards a rear portion of said cantilever beam with which said enlarged portion is associated, each of said enlarged portions also having a cam locking surface which, when viewed from said front face of the other connector, extends generally downwardly and rearwardly from a top surface of each of said cantilever beams;

whereby said cantilever beams are deflected upwardly by engagement of said cam locking surfaces and said first inclined ramp surface of said double ramp member during movement of said pair of matable connectors towards a mated position, whereby said cantilever beams and said enlarged portions thereof surround said double ramp member to lock said matable connectors in a mated position, and whereby said cam releasing surfaces of said enlarged portions of said cantilever beams are drawn along said wedge shape of said second ramp surface of said double ramp member to spread said cantilever beams apart to permit easy unmating of said matable connectors.

2. The easily releasable overcenter locking means for a pair of matable electrical connectors as defined in claim 1 wherein: drawer slide means are provided in part on one of the connectors and in part on the other of the connectors, said drawer slide means for guiding the matable electrical connectors towards their mated position in a manner such that said pair or cantilever beams are accurately aligned with said double ramp member during movement of the matable connectors to their mated position.

3. The easily releasable overcenter locking means for a pair of rotable connectors as defined in claim 2 wherein: the one matable connector has at least a pair of double ramp members formed thereon and the other connector has as many pairs of cantilever beams formed thereon as there are double ramp members on the one connector.

* * * * *